US012339108B2

(12) United States Patent
Arzt et al.

(10) Patent No.: US 12,339,108 B2
(45) Date of Patent: Jun. 24, 2025

(54) SABOT

(71) Applicant: Rheinmetall Waffe Munition GmbH, Südheide (DE)

(72) Inventors: Konstantin Arzt, Adelheidsdorf (DE); Michael Gowin, Hermannsburg (DE); Ulrich Keller, Unterlüß (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 196 days.

(21) Appl. No.: 18/081,786

(22) Filed: Dec. 15, 2022

(65) Prior Publication Data

US 2023/0116071 A1 Apr. 13, 2023

Related U.S. Application Data

(63) Continuation of application No. PCT/EP2021/064791, filed on Jun. 2, 2021.

(30) Foreign Application Priority Data

Jun. 15, 2020 (DE) ..... 10 2020 115 703.7

(51) Int. Cl.
*F42B 14/06* (2006.01)

(52) U.S. Cl.
CPC ..... *F42B 14/061* (2013.01)

(58) Field of Classification Search
CPC .... F42B 14/064; F42B 14/062; F42B 14/061; F42B 14/06
See application file for complete search history.

(56) References Cited

U.S. PATENT DOCUMENTS 2,996,010 A * 8/1961 Frantik ..... F42B 14/064 102/523
3,496,869 A * 2/1970 Engel ..... F42B 14/064 102/522

(Continued)

FOREIGN PATENT DOCUMENTS

DE 3724401 A1 5/1989
DE 3930255 A1 * 3/1991

(Continued)

OTHER PUBLICATIONS

International Search Report from corresponding PCT Application No. PCT/EP2021/064791, dated Sep. 28, 2021.

*Primary Examiner* — Derrick R Morgan
(74) *Attorney, Agent, or Firm* — Muncy, Geissler, Olds & Lowe, P.C.

(57) ABSTRACT

The invention relates to a sabot (1) which comprises multiple sabot segments (1.1, 1.2, 1.3). The sabot (1) or the sabot segments (1.1, 1.2, 1.3) are characterized by having a structural design at an end (10) opposite the shooting direction such that a low degree of flexural rigidity is achieved at said end (10). A sabot (1) with three sabot segments (1.1, 1.2, 1.3) is preferred. The sabot (1) or the sabot segments (1.1, 1.2, 1.3) have a rear part (3) as a push part and a front part (4) as a pull part. In order to optimize the shape and weight, the front part (4) and the rear part (3) have recesses (5, 6) in the sabot (1) or in the sabot segments (1.1, 1.2, 1.3). Braces (8, 9) are integrated between the recesses (5, 6), or the recesses (5, 6) are introduced between braces (8, 9).

13 Claims, 2 Drawing Sheets

(56) References Cited

U.S. PATENT DOCUMENTS 3,771,458 A * 11/1973 Schweimler ..... F42B 14/064 102/523
3,862,603 A * 1/1975 Kornblith ..... F42B 14/061 102/522
4,284,008 A * 8/1981 Kirkendall ..... F42B 14/02 102/521
4,296,687 A * 10/1981 Garrett ..... F42B 14/064 102/518
4,326,464 A * 4/1982 Price ..... F42B 14/061 102/518
4,450,770 A * 5/1984 Kirkendall ..... F42B 14/061 102/524
4,467,724 A * 8/1984 Marlow ..... F42B 14/061 102/520
4,469,027 A * 9/1984 Burns ..... F42B 14/061 102/521
4,590,862 A * 5/1986 Grabarek ..... F42B 14/064 102/703
4,638,738 A * 1/1987 Bisping ..... F42B 14/061 102/516
4,651,649 A * 3/1987 Nussbaum ..... F42B 14/06 102/521
4,709,638 A * 12/1987 Broden ..... F42B 14/064 102/522
4,719,860 A * 1/1988 Ruffle ..... F42B 14/061 102/521
4,735,148 A * 4/1988 Holtzman ..... F42B 14/064 102/522
4,776,280 A * 10/1988 Burri ..... F42B 14/064 102/522
4,841,867 A * 6/1989 Garrett ..... F42B 14/064 102/523
4,920,889 A * 5/1990 Luther ..... F42B 14/061 102/521
4,936,220 A * 6/1990 Burns ..... F42B 14/061 102/521
4,967,668 A * 11/1990 Warren ..... F42B 14/061 102/439
5,297,492 A * 3/1994 Buc ..... F42B 14/061 102/521
5,359,938 A * 11/1994 Campoli ..... F42B 14/061 102/521
6,073,560 A * 6/2000 Stone ..... F42B 14/064 102/522
6,626,113 B1 * 9/2003 Gilman ..... F42B 8/02 102/521
6,662,726 B1 * 12/2003 Steiner ..... F42B 12/06 102/521
7,444,942 B2 * 11/2008 Hall ..... F42B 14/06 102/522
8,069,791 B1 * 12/2011 Kunstmann ..... F42B 14/064 102/521
8,640,625 B1 * 2/2014 Wong ..... F42B 8/14 102/444
8,695,507 B1 * 4/2014 Musali ..... F42B 14/061 102/524
8,887,641 B1 * 11/2014 Manole ..... F42B 14/06 102/521
9,052,172 B2 * 6/2015 Whitworth ..... F42B 14/04
9,182,202 B2 * 11/2015 Menefee, III ..... F42B 7/10
9,677,863 B1 * 6/2017 Palathingal ..... F42B 14/061
10,295,290 B2 * 5/2019 Fellows ..... F41A 21/18
2005/0016413 A1 * 1/2005 Eches ..... F42B 14/061 102/521
2013/0000506 A1 * 1/2013 Minnicino, II ..... F42B 14/06 102/521
2019/0041175 A1 * 2/2019 Fellows ..... F42B 14/061

FOREIGN PATENT DOCUMENTS

DE 3920254 C2 1/1992
DE 3843566 C1 4/1995
DE 19843787 C1 3/2000
DE 10320194 A1 12/2004
DE 19944376 B4 5/2007
DE 102013006498 A1 10/2014
DE 102019125128 A1 3/2021
EP 0403730 A2 12/1990
EP 0626558 A1 11/1994
EP 0990869 A1 4/2000

* cited by examiner

SABOT

CROSS-REFERENCE TO RELATED APPLICATIONS

This application is a continuation application of PCT Application No. PCT/EP2021/064791, filed on 2 Jun. 2021, which claims the benefit and priority to German Patent Application No. 10 2020 115 703.7, filed on 15 Jun. 2020. The entire disclosures of the applications identified in this paragraph are incorporated herein by references.

FIELD

The invention relates to a sabot of a sub-caliber KE munition or of a sub-caliber KE penetrator. The invention relates in particular to a sabot having several, at least two, preferably three, sabot segments. The sabot or the sabot segments are constructed such as to have a push-pull function. A part located in front of a pressure flange of the sabot accelerates the projectile by means of pressure, and a part located behind it accelerates the projectile by means of traction.

BACKGROUND

A sabot of a sub-caliber KE penetrator fulfills several functions. For example, the sabot must seal an annular gap remaining between the projectile and the tube wall of a weapon barrel, so that the propellant gases can be effectively used to drive the projectile. In addition, the sabot guides the projectile in the weapon barrel so that it follows towards the tube bore axis without lateral deflections and thus as precisely as possible. In the case of highly sub-calibered projectiles, the sabot must support the projectile during acceleration in the weapon barrel, whereby the force introduced into the projectile via the sabot is distributed over a larger area of the projectile length. In the case of a punctiform introduction of force under the effect of inertial forces, the projectile would otherwise collapse or tear off.

The sabot and the projectile separate after passing the muzzle. A terminal ballistic effect is produced solely by the projectile as a flying projectile. Detachment before the muzzle takes place due to the fact that the sabot has multiple parts. The sabot is divided into a plurality of segments which, starting from the tip, detach radially from the projectile as soon as they are no longer held together by the tube wall. The necessary driving force is generally generated by an air pocket which is exposed to the dynamic pressure by the ambient air.

In practice, there are pure push sabots or pure pull sabots. The pressure flange of the sabot is located either behind or in front of the actual sabot. In order to realize as low a sabot mass as possible, both push and/or pull sabots are shape-optimized. In addition, high-strength materials are used. As a result, the material is stressed to a high degree, as uniformly as possible.

DE 198 43 787 C1 discloses a sub-caliber KE projectile with a penetrator and a segmented central sabot, which comprises two supports arranged axially one behind the other. It is provided that a front and a rear air pocket are designed such that the dynamic pressure resulting during flight of the KE penetrator results in a common force application point. This common force application point should lie within a partial region in which a sleeve cover and a sabot are glued to one another and have a distance from a rear end of the sabot. This is intended to prevent the penetrator from oscillating.

A segmented sabot can also be gathered from DE 199 44 376 B4. It has a front first support and a second rear support arranged at an axial distance behind the first one. A releasable sabot for a sub-caliber projectile can be gathered from DE 103 20 194 A1. It has a plurality of sabot segments.

DE 10 2013 006 498 A1 discloses a sabot projectile which is characterized in that a narrow segmented steel disk is used as the guide element, which is connected in a form-fitting and/or force-fitting manner to a segmented, hollow cylindrical trim part made of plastic on the side facing the guide sabot. Typical for high-performance KE munitions are sabots in which a pressure flange lies approximately in the center of the elongated, arrow-like flying projectile. A part of the sabot lying in front of said pressure flange accelerates the projectile by means of pressure, and a part lying behind it accelerates the projectile by means of traction. In addition, a propellant pressure acts on the pull part, while the push part is free of external loads. Such sabots are also referred to as push-pull sabots.

The conventional push-pull sabots are designed to be very rigid on the rear of the sabot. This shortens the interaction time during detachment; however, because of this high rigidity, these sabots have a low damping effect. This results in lateral disturbances (detachment shocks) being transmitted directly onto the projectile during the detachment process. If this load is asymmetrical, an external transmission onto the flying projectile is problematic, as a result of which the projectile can be excited to oscillate.

DE 10 2019 125 128.1, which was not a prior document, relates to a sabot which is designed such as to have a push function, on the one hand, and a pull function, on the other, whereas these functions act or are present independently of one another. As a result of this design, there is a separation of the push and pull functions at the sabot. In order to separate the function, the sabot is divided or separated into sabot parts such that at least one sabot part takes over the pull function and at least one further sabot part takes over the push function. The sabot parts are in turn connected to a projectile by means of a positive connection. A positive connection between the sabot parts can be dispensed with, however. Preferably, the sabot parts are, however, mechanically separated from one another so that there is no positive connection between them. In that case, the sabot is a multi-part sabot. Alternatively, however, a mechanical connection between the sabot parts can be provided, whereby the sabot is a single-part sabot in case of a division of the functions. This reduces the mass of the sabot.

SUMMARY

The object of the invention is to make the detachment process of a sabot smoother, such as to reduce an initial oscillation of the flying projectile.

The object is achieved by the features of claim 1. Preferred embodiments can be found in the dependent claims.

A segmented releasable sabot is known from DE 39 20 254 C2, which consists among other things of at least two sabot segments with adjacent plane-parallel segment separation surfaces. Here, there is a reference that, the lower the sabot mass and especially the lower the mass moment of inertia of the sabot segments about their rear rolling edge, the faster the detachment process and the lower the kinetic energy loss of the penetrator. To this end, the penetrator has a constriction with a rear rolling edge. The sabot segments are in turn provided with a corresponding shaping in this region.

The idea underlying the invention is to provide a sabot having several segments. The sabot itself can have at least two, preferably three segments. More than three segments are also possible. These segments have a structural design at their rear ends opposite the shooting direction such that they are almost cylindrical and very thin in terms of wall thickness. In case of an ammunition in the caliber of for example 105 mm, this cylinder shape can be created within the last 20 mm to 30 mm of the sabot. The wall thickness can be approximately 3.5 mm to 4.5 mm. In case of an ammunition in a smaller caliber, the cylindrical region of the sabot is to be selected to be shorter and the wall thickness to be correspondingly smaller. In case of an ammunition in a larger caliber, the cylindrical region of the sabot should be longer and the wall thickness thicker. At these ends, the sabot or the sabot segments roll over the projectile during detachment.

These special ends have a low degree of flexural rigidity. Due to this flexibility, the ends designed in this way can reduce impulsive forces occurring between the sabot and the projectile. As a result, an additional rolling edge on the penetrator can be dispensed with during production while improving the detachment of the sabot or the sabot segments and the projectile or penetrator. The advantages resulting from this construction are, inter alia, that a lower initial oscillation is achieved and thus an optimization of the dispersion pattern.

The sabot or the sabot segments are moreover constructed such as to assume a push-pull function.

A sabot with a push-pull function comprising a plurality of sabot segments is proposed. The sabot or the sabot segments are characterized by having a structural design at an end opposite the shooting direction such that a low degree of flexural rigidity is achieved at said end. At this end, the sabot has a cylinder shape (a kind of tiny tail) which has a low degree of flexural rigidity such that impulsive forces are reduced and the sabot rolls off during detachment. A sabot with three sabot segments is preferred. The sabot or the sabot segments have a part located behind a pressure flange as a push part, and a part located in front of the pressure flange as a pull part. In order to optimize the shape and weight, the part located behind the pressure flange and the part located in front of the pressure flange have recesses. The recesses are introduced between braces, or braces remain between the recesses. The sabot or the sabot segments have pockets which are integrated in the part located behind the pressure flange.

BRIEF DESCRIPTION OF THE DRAWINGS

The invention is to be explained in more detail with reference to an embodiment with a drawing.

The drawing shows.

DETAILED DESCRIPTION

Figure 1:
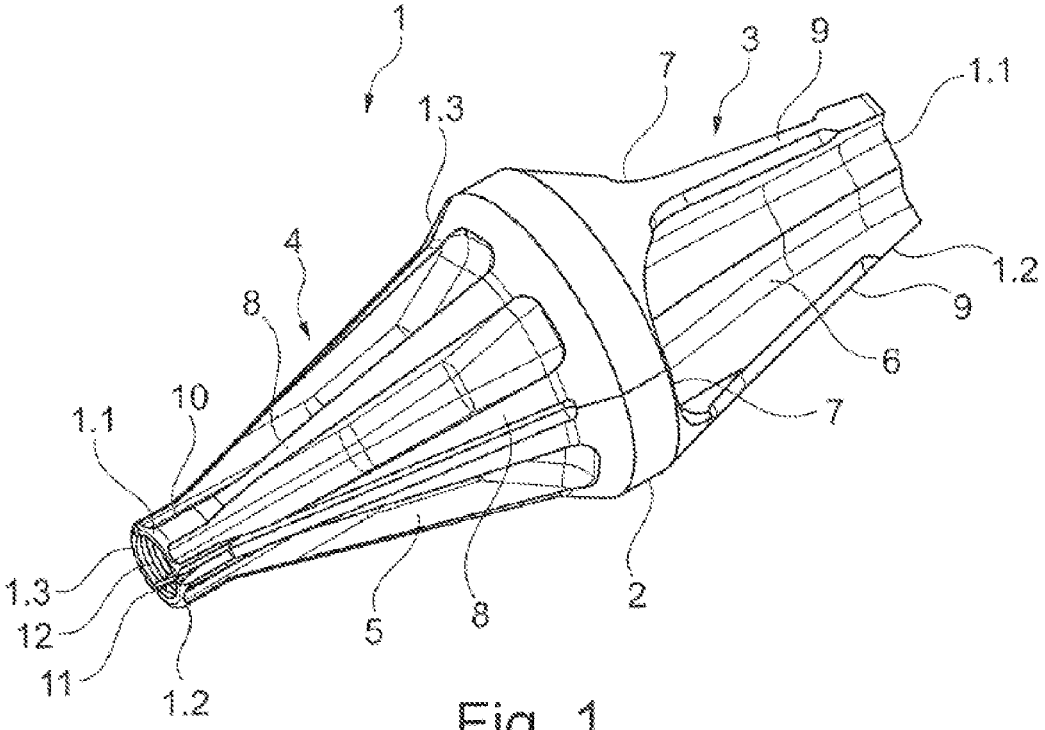
FIG. 1 shows a sabot according to the invention in a perspective view in the shooting direction from behind.

In FIG. 1, a sabot 1 is shown for a sub-caliber projectile (not shown in greater detail). The sabot 1 is shown obliquely from the rear when viewed in the shooting direction. The sabot 1 has at least two sabot segments 1.1, 1.2. The sabot 1 preferably has three sabot segments 1.1, 1.2, 1.3. Plastic, aluminum or the like can be used as material. Such materials are customary and known.

The sabot 1 or the sabot segments 1.1, 1.2, 1.3 are characterized in that they are designed as a push-pull sabot or push-pull sabot segments. A part 3 of the sabot segments 1.1, 1.2, 1.3 (front part) located in front of a pressure flange 2 accelerates the sub-caliber projectile (not shown in greater detail) by means of pressure, and a part 4 (rear part) located behind of the pressure flange 2 accelerates it by means of traction. In addition, a propellant pressure acts on the pull part 4, while the push part 3 is free of external loads.

The front part 3 (push part) and the rear part 4 (pull part) are in turn preferably optimized in terms of shape and weight. For this purpose, the rear part 4 and the front part 3 have recesses 5, 6 in the sabot segments 1.1, 1.2, 1.3. Braces 8, 9 remaining between these recesses serve to ensure sufficient rigidity of the sabot 1 or the sabot segments 1.1, 1.2, 1.3.

The sabot 1 or the sabot segments 1.1, 1.2, 1.3 have pockets 7 integrated in the rear part 3.

According to the invention, the sabot 1 or the sabot segments 1.1, 1.2, 1.3 have a structural design at an end 10 opposite the shooting direction such as to be very thin, as some kind of tiny tail. In case of an ammunition in the caliber of for example 105 mm, this cylinder shape (or tiny tail) can be created within the last 20 mm to 30 mm of the sabot 1 or the sabot segments 1.1, 1.2, 1.3. The wall thickness can be approximately 3.5 mm to 4.5 mm. As a result of this design, this special end 10 has a low degree of flexural rigidity. Due to this flexibility, impulsive forces occurring between the sabot 1 or the sabot segments 1.1, 1.2, 1.3 and the projectile or penetrator (not shown in greater detail) can be reduced. The homogenization of the detachment forces of all sabot segments 1.1, 1.2, 1.3 also reduces the initial oscillation of the projectile. A so-called detachment edge 11 is introduced between the sabot segments 1.1, 1.2, 1.3.

A receptacle of the projectile (not shown in greater detail) is denoted by 12. Projectile and sabot 1 are connected to one another via an indicated threaded connection.

Figure 2:
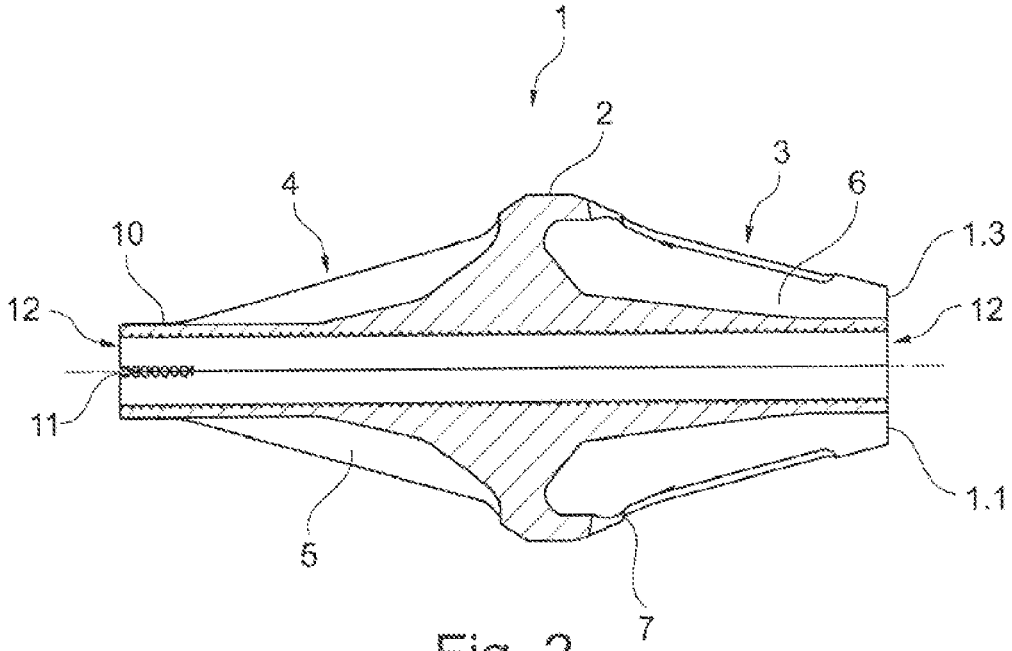
FIG. 2 shows a sectional illustration of the sabot of FIG. 1.

FIG. 2 shows the sabot 1 or a sabot segment 1.1, 1.2, 1.3 in a sectional view.

The mode of operation is as follows:

As a result of the propellant gases, the sabot 1 or the sabot segments 1.1, 1.2, 1.3 together with the projectile are driven through a weapon barrel (not shown in greater detail). The weapon barrel is responsible for guiding the projectile in the weapon barrel. The sabot 1 and the projectile separate after passing the muzzle, and the sabot segments 1.1, 1.2, 1.3 separate after passing the muzzle. The necessary force is generated by the dynamic pressure in the pockets 7 of the sabot 1 or the sabot segments 1.1, 1.2, 1.3 when these pockets 7 are exposed to ambient air. The sabot 1 or the sabot segments 1.1, 1.2, 1.3 roll over the projectile during detachment. Due to the low flexural strength of the ends 10 of the sabot 1 or of the sabot segments 1.1, 1.2, 1.3, the detachment forces of the sabot 1, i.e., of all sabot segments 1.1, 1.2, 1.3, are homogenized.

What is claimed is:

1. A sabot having a push-pull function, comprising:

a plurality of sabot segments adjacent in a circumferential direction, each of the plurality of sabot segments comprising:

a front push-part;

a rear pull-part;

a pressure flange between the front push-part and the rear pull-part;

a front end arranged in a shooting direction of the sabot;

a rear end arranged opposite to the shooting direction, wherein the sabot and the plurality of sabot segments has a structural design at the rear end such that the sabot has a low flexural resistance, wherein the sabot has a cylindrical-shaped portion at the rear end such that the plurality of sabot segments are configured to roll during detachment, wherein the rear pull-part has a first proximal end proximal to the pressure flange and a second distal end distal from the pressure flange, the second distal end of the rear pull-part being disposed at the rear end of the sabot, the second distal end of the rear pull-part having a thinner wall thickness than the first proximal end of the rear pull-part, the second distal end of the rear pull-part having the thinner wall thickness forming the cylindrical-shaped portion, wherein the rear pull-part and the front push-part have recesses, the recesses extending along the rear pull-part from the pressure flange toward the rear end of the sabot and the recesses extending along the front push-part from the pressure flange toward the front end, which are open radially outwards, within the sabot segments, the recesses being delimited in the circumferential direction by struts extending in the shooting direction between the rear end and the pressure flange and between the front end and the pressure flange.

2. The sabot according to claim 1, wherein the sabot comprises at least two sabot segments.

3. The sabot according to claim 1, wherein the sabot comprises three sabot segments.

4. The sabot according to claim 1, wherein the sabot has pockets which are integrated in the front push-part.

5. The sabot according to claim 1, wherein the material of the sabot is plastic, aluminum or the like.

6. An ammunition having a sabot according to claim 1.

7. The ammunition according to claim 6, wherein the ammunition in caliber is 105 mm.

8. The ammunition according to claim 6, wherein the cylinder shape can lie within the last 20 mm to 30 mm of the sabot.

9. The ammunition according to claim 7, wherein the wall thickness can be approximately 3.5 mm to 4.5 mm.

10. The sabot according to claim 1, wherein the struts extend along the rear pull-part from the proximal end of the rear pull-part toward the distal end of the rear pull-part and end at a position before the cylindrical-shaped portion.

11. The sabot according to claim 1, wherein the struts do not extend into the cylindrical-shaped portion.

12. A sabot, comprising:

a plurality of sabot segments adjacent in a circumferential direction, each of the plurality of sabot segments comprising:

a front push-part;

a rear pull-part;

a pressure flange between the front push-part and the rear pull-part, wherein the rear pull-part and the front push-part have recesses, which are open radially outwards, within the sabot segments, the recesses being delimited in the circumferential direction by struts extending in a shooting direction between a rear end of the rear pull-part and the pressure flange and between a front end of the front push-part and the pressure flange, in the front push-part, the recesses extending from the pressure flange along the front push-part to an end of the front push-part and in the rear pull-part, the recesses extending from the pressure flange along the rear pull-part to an end of the rear pull-part, wherein the plurality of sabot segments has a cylindrical-shaped portion at the rear end, the cylindrical-shaped portion having a low flexural resistance configured to roll during detachment of the plurality of sabot segments.

13. A sabot having a push-pull function, comprising:

a plurality of sabot segments adjacent in a circumferential direction, each of the plurality of sabot segments comprising:

a front push-part arranged in a shooting direction of the sabot;

a rear pull-part arranged opposite the shooting direction of the sabot; and a pressure flange between the front push-part and the rear pull-part, wherein the front push-part has a first proximal end proximal to the pressure flange and a second distal end distal from the pressure flange, and the rear pull-part has a first proximal end proximal to the pressure flange and a second distal end distal from the pressure flange, the second distal end of the rear pull-part having a thinner wall thickness than the first proximal end of the rear pull-part, wherein the sabot has a cylindrical-shaped portion at the second distal end of the rear pull-part, the cylindrical-shaped portion being formed by the second distal end of the rear pull-part having the thinner wall thickness configured to roll during detachment of the plurality of sabot segments, and wherein the rear pull-part and the front push-part have recesses, which are open radially outwards, within the sabot segments, the recesses being delimited in the circumferential direction by struts extending in the shooting direction between a rear end of the sabot and the pressure flange and between a front end of the sabot and the pressure flange, in the front push-part, the recesses extending from the pressure flange along the front push-part to the second distal end of the front push-part and in the rear pull-part, the recesses extending from the pressure flange along the rear pull-part to the second distal end of the rear pull-part.

* * * * *